US006801130B2

(12) United States Patent
Campero

(10) Patent No.: US 6,801,130 B2
(45) Date of Patent: Oct. 5, 2004

(54) INVENTORY MANAGEMENT SYSTEM

(75) Inventor: Richard John Campero, Ellicott City, MD (US)

(73) Assignee: MeadWestvaco Corporation, Stamford, CT (US)

( * ) Notice: Subject to any disclaimer, the term of this patent is extended or adjusted under 35 U.S.C. 154(b) by 20 days.

(21) Appl. No.: 10/269,766

(22) Filed: Oct. 11, 2002

(65) Prior Publication Data

US 2004/0070507 A1 Apr. 15, 2004

(51) Int. Cl.[7] ..... G08B 13/14

(52) U.S. Cl. ..... 340/572.1; 340/572.3; 340/5.92; 235/7 R

(58) Field of Search ..... 340/572.1–572.9, 340/571, 5.92, 825.36; 235/7 R, 462.13, 462.14, 462.45, 385; 705/22, 28

(56) References Cited

U.S. PATENT DOCUMENTS 4,709,813 A * 12/1987 Wildt ..... 206/312
4,881,061 A * 11/1989 Chambers ..... 340/572.1
5,151,684 A * 9/1992 Johnsen ..... 340/568.1
5,535,606 A * 7/1996 Nguyen et al. ..... 70/57.1
5,874,896 A * 2/1999 Lowe et al. ..... 340/572.1
5,942,978 A * 8/1999 Shafer ..... 340/572.9
5,955,951 A * 9/1999 Wischerop et al. ..... 340/572.8
6,195,006 B1 * 2/2001 Bowers et al. ..... 340/572.1
6,352,606 B1 * 3/2002 DiMarco et al. ..... 156/212
6,474,117 B2 * 11/2002 Okuno ..... 70/57.1
6,621,410 B1 * 9/2003 Lastinger et al. ..... 340/10.42

* cited by examiner

*Primary Examiner*—Benjamin C. Lee
*Assistant Examiner*—Phung Nguyen
(74) *Attorney, Agent, or Firm*—Donald L. Bowman

(57) ABSTRACT

The invention provides an improved inventory management and theft detection system whereby by a security tag is placed on an article for sale. The security tag is affixed to the article so that the article cannot be opened when the security tag is in place. A device to remove the security tag is controlled by the cash register of the store. The security tag removal device is controlled by the cash register and does not operate unless a sales transaction has occurred.

2 Claims, 1 Drawing Sheet

100

INVENTORY MANAGEMENT SYSTEM

CROSS-RELATED APPLICATIONS

This application claims priority from U.S. Provisional Application No. 60/328,193 filed Oct. 11, 2001.

BACKGROUND OF THE INVENTION

This invention relates to an apparatus and system for securing and managing inventory, such as an article security tag and security tag release device, and point of sale terminal.

Various types of containers are known for holding products such as in a retail store. Numerous security and inventory management systems have been developed such as theft detection tags, physical objects to be removed by the sales clerk, and bar codes. One exemplary product to be managed is information storage media, such as compact discs (CD's) and digital video discs (DVD's). An exemplary state of the art container for storage media is described in U.S. Pat. No. 5,788,068 and WO97/41563, the disclosures of which are incorporated by reference herein.

An exemplary problem with prior art containers for storage media is the theft of the storage media, e.g. the CD or DVD, from the container inside the retail store. Conventionally, containers are provided with an Electronic Article Surveillance (EAS) tag that triggers an alarm if the container is taken out of the store without the EAS tag either being removed or rendered inactive by the store sales staff. One way to counter an EAS tag is simply to remove the storage media from the container. One method of countering this theft technique is to wrap the container in a clear plastic wrapper. The wrapper must be at least partially removed before the container can be opened. However, thieves have been known to slit the wrapper along an edge of the container and removed the storage media by manipulating the container. Moreover, thieves have developed additional techniques to include removing the EAS tag from the container or product.

U. K. Patent Application No. 00275537 ('537) describes an improved security tag that secures storage media inside the container. The security tag described in this application secures the storage media in the container and prevents the container from opening while the security tag is in place. However one potential problem with the '537 application is that an employee or thief with access to a security tag removal system can circumvent this feature.

What is needed is an improved inventory management and theft deterrent system whereby a security tag, such as described in the '537 application cannot be removed unless a sales transaction has occurred.

SUMMARY OF THE INVENTION

The invention provides an improved inventory management system whereby by a security tag is placed on an article for sale. The security tag is affixed to the article so that a packaging cannot be opened with the security tag in place. A device to remove the security tag is controlled by the point of sale terminal. The tag removal device will not operate unless a sales transaction takes place.

BRIEF DESCRIPTION OF THE FIGURE

The above and other features of the present invention which will become more apparent in the description below and can be understood by the following detailed description in conjunction with the accompanying FIGURE.

DETAILED DESCRIPTION OF THE INVENTION

Figure 1:
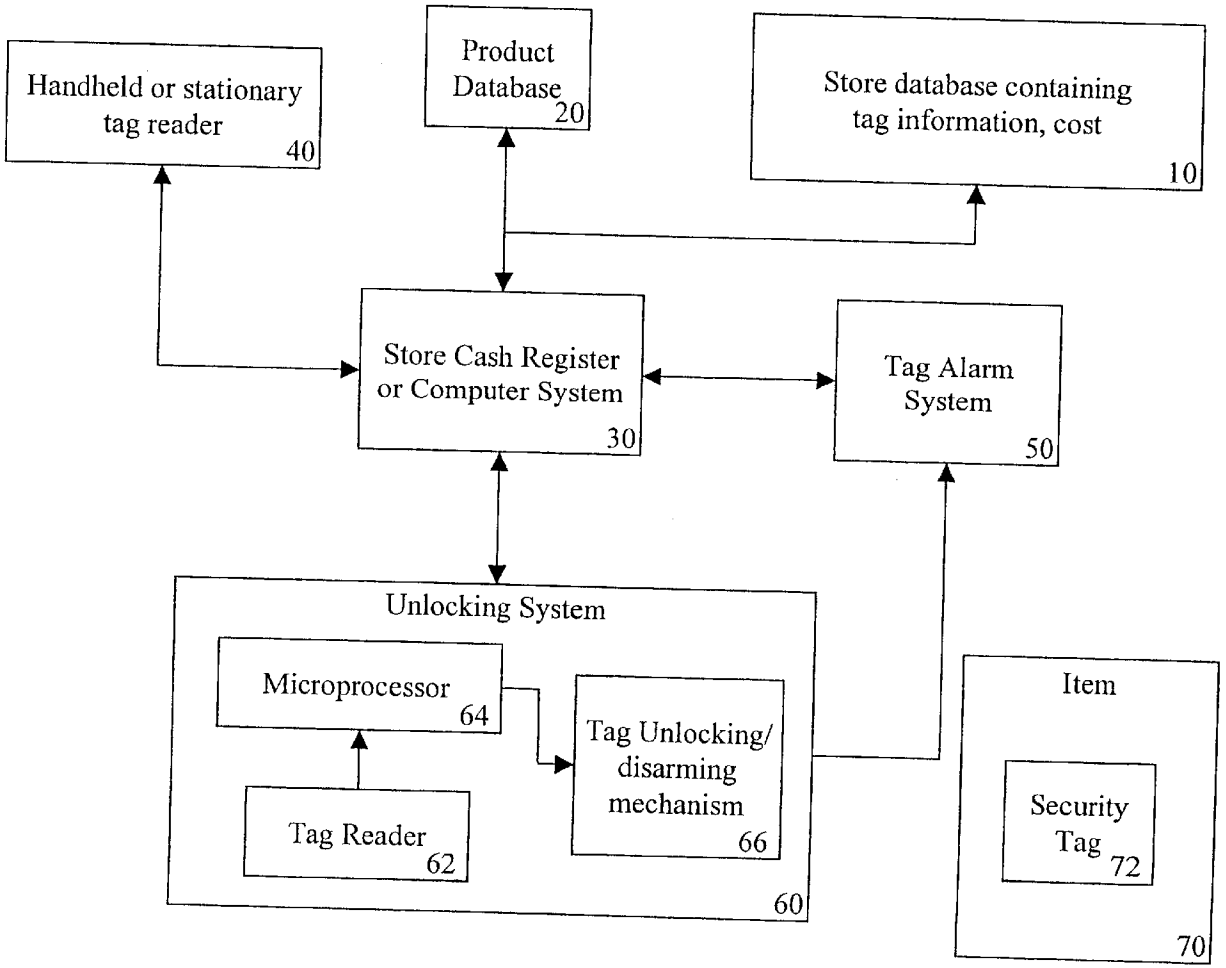
FIG. 1 is a schematic diagram of an inventory management system according to the invention.

FIG. 1 is a schematic diagram of an inventory management system 100. An exemplary inventory item 70 is shown. In an exemplary embodiment, item 70 is a storage media container (not shown) with an information storage media, such as a CD or DVD located inside the container. The storage media is secured inside the container by a security tag 72 such as described in the '537 application tat uses a RFID tags for preventing theft. In an exemplary embodiment, the security tag 72 has a Radio Frequency Identification Device (RFID) attached to it. It is to be understood that the invention covers a wide range of security tags 72 and is not limited to the security tag described in the referenced '537 application.

The inventory system 100 consists of at least a storage database 10, a cash register or sales terminal 30, an inventory item 70, a security tag 72 secured to the inventory item 70 or a container for the item 70, a security tag reader 40, and an unlocking system 60. FIG. 1, also shows an optional remote database 20 and an alarm system 50, such as an audible alarm located near the exits of a facility.

The inventory system 100 is designed so that security tag 72 is only released from an item 70 after a cash register 30 has recorded the sale of the item 70. In an exemplary system, the security tag 72 contains at least a serial number or some identification information that can be read by an optical or other type of scanner. Additional information could be stored on the tag, such as item type, item identification number, tag number, item description, item cost, date of manufacture, shipping date and reorder information. A serial number allows each item 70 and security tag 72 to be uniquely identified by the cash register or computer system 30. The security tag 72 is exemplary placed in the item 70 at the factory or by the retailer, distributor, or owner, preferably prior to arrival at the store or in a secure location. An optional remote database 20 could be used to cross-reference the information stored on the tag 72.

In an exemplary embodiment, during a sales transaction, the cash register 30 or other suitable reading device will read the security tag 72 identification information. In an exemplary system a handheld or stationary security tag reader 40, such as an electronic or optical scanner is used to read the security tag 72. The tag reader 40 transfers the information to the cash register 30. The cash register 30 then communicates with a storage database 10. The storage base 10 transmits to the cash register 30 information on the item 70, such as product cost and other information desired. In addition, a remote product database 20 may be desirable to prevent an employee or thieve from altering the store database 10.

After the security tag 72 information is read by the tag reader 40, the cash register 30 will authorize the removal of or disarming of the security tag 72. A sales clerk can then use an exemplary tag unlocking system 60 to remove the security tag 72 from the item 70. The tag unlocking system 60 is controlled by the cash register 30. In an exemplary embodiment the tag unlocking system 60 comprises a security tag reader 62, a microprocessor 64, and an unlocking device 66.

The unlocking system tag reader 62 reads the security tag 72. The tag's identification number is transferred via a microprocessor 64 to the cash register 30 to confirm or verify the sale. If a sale is confirmed, the unlocking device 66 is made operational and the sales clerk can proceed with disarming and removing the security tag 72. If a sale is not confirmed then the unlocking device 66 will not operate. In an exemplary embodiment, an attempt to unlock a security tag 72 when a sale is not recorded would result in an exemplary alarm system 50 activating.

Thus employees as well as thieves could not remove the security tag 72 from the item 70 without a sales transaction. It is to be understood that the unlocking device 66 can be configured and controlled in many different ways, including electromagnetic controls or other suitable electromechanical means.

As previously mentioned, the system 100 could also have an alarm system 50. An exemplary alarm system 50 would be placed near the store exit or tag unlocking device 661. The alarm 50 would make a noise or flash a light if a thief or employee attempts to remove the item 70 from the store without a sales transaction occurring.

One potential problem is that an employee could authorize a cash transaction with the cash register 30, without placing the money in the cash register. However, a password system can also be used with the cash register 30 to identify which sales clerk handled a particular transaction.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A system for controlling the removal of a security tag comprising:

one or more inventory items comprising a container with at least one moveable portion so that said container can be opened and closed and wherein said container comprises a media storage device;

a security tag secured to each inventory item wherein said security tag contains identification information on the inventory item and wherein said security tag must be removed from said inventory item by a security tag removal device in order to open and close said container and gain access to said media storage device;

a inventory database;

a point of sale terminal, wherein said point of sale terminal has a means to read said identification information on said security tag, communicate said information to said inventory datatbase, and generate an output signal to said security tag removal device; and a security tag removal device for removing said security tag from said inventory item wherein said security tag removal device reads the identification information from said security tag and compares said identification information with said point of sale terminal output signal, verifies that said inventory information matches prior to removing said security tag, and generates an update signal to said inventory database.

2. The system of claim 1 further comprising an alarm system in communication with a security tag detection system wherein said alarm system generates an alarm signal when a security tag passes said security tag detection system.

* * * * *